US009121201B2

(12) United States Patent
Valade, Jr. et al.

(10) Patent No.: US 9,121,201 B2
(45) Date of Patent: Sep. 1, 2015

(54) MAGNETICALLY RELEASABLE SECURITY TAG

(75) Inventors: Franklin H. Valade, Jr., Fort Walton Beach, FL (US); Qiuxia Hu, Shanghai (CN); Charles T. Turgeon, Lighthouse Point, FL (US); Thang Tat Nguyen, Boca Raton, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 6 days.

(21) Appl. No.: 13/555,323

(22) Filed: Jul. 23, 2012

(65) Prior Publication Data

US 2013/0036780 A1 Feb. 14, 2013

(30) Foreign Application Priority Data

Jul. 29, 2011 (CN) ..... 2011 1 0225691

(51) Int. Cl.
*E05B 65/00* (2006.01)
*E05B 73/00* (2006.01)
*G08B 13/24* (2006.01)

(52) U.S. Cl.
CPC ..... *E05B 73/0017* (2013.01); *E05B 73/0029* (2013.01); *E05B 73/0052* (2013.01); *G08B 13/2434* (2013.01); *G08B 13/2448* (2013.01); *Y10T 70/7051* (2015.04); *Y10T 70/7057* (2015.04)

(58) Field of Classification Search
CPC ..... E05B 73/0017; E05B 73/0052; E05B 73/0005; E05B 73/0047; E05B 47/0038; E05B 67/00; Y10T 70/5004; Y10T 70/7057; Y10T 70/5009; Y10T 70/7904
USPC ..... 70/14, 18, 30, 49, 58, 57.1, 276
See application file for complete search history.

(56) References Cited

U.S. PATENT DOCUMENTS

| | | | | |
|---|---|---|---|---|
| 5,079,540 | A * | 1/1992 | Narlow et al. | 340/572.8 |
| 5,517,835 | A * | 5/1996 | Smith | 70/14 |
| 6,128,932 | A * | 10/2000 | Mainetti et al. | 70/57.1 |
| 6,933,847 | B2 * | 8/2005 | Feibelman | 340/572.1 |
| 7,243,963 | B2 * | 7/2007 | De Lima Castro | 292/315 |
| 7,403,118 | B2 * | 7/2008 | Belden, Jr. | 340/568.2 |
| 7,474,209 | B2 * | 1/2009 | Marsilio et al. | 340/568.1 |
| 7,659,817 | B2 * | 2/2010 | Conti et al. | 340/568.2 |
| 8,978,427 | B2 * | 3/2015 | Ho et al. | 70/57.1 |
| 2007/0240460 | A1 * | 10/2007 | Marsilio et al. | 70/57.1 |
| 2008/0316028 | A1 * | 12/2008 | Conti et al. | 340/568.2 |
| 2012/0007711 | A1 * | 1/2012 | Lehnbeuter | 340/5.6 |
| 2012/0234056 | A1 * | 9/2012 | Thoonsen | 70/52 |
| 2012/0326871 | A1 * | 12/2012 | Lian et al. | 340/572.1 |

* cited by examiner

*Primary Examiner* — Suzanne Barrett

(57) ABSTRACT

A security tag is provided that includes a housing, an electronic sensor held within the housing, an accessory pin provided with the housing and a lock assembly held within the housing. The accessory is pin provided with the tag housing and may be moveable with respect to the housing between locked and unlocked positions. When the accessory pin is in the locked position, the tag housing is secured to the accessory. When the accessory pin is in the unlocked position, the tag housing is disengaged from the accessory. The lock assembly may include a magnetically influenced (MI) member which is movable from a biased position to a relaxed position in the absence of the selected magnetic field to lock the accessory pins.

22 Claims, 6 Drawing Sheets

MAGNETICALLY RELEASABLE SECURITY TAG

BACKGROUND OF THE INVENTION

The subject matter disclosed herein relates to electronic article surveillance (EAS) and more particularly to systems and methods for securing of an EAS to an accessory.

An EAS system is designed to prevent unauthorized removal of an item from a controlled area. A typical EAS system may comprise a monitoring system and one or more security tags. The monitoring system may create a surveillance zone at an access point for the controlled area. A security tag may be fastened to the monitored item, such as a garment or article of clothing. If the monitored item enters the surveillance zone, an alarm may be triggered indicating unauthorized removal of the monitored item from the controlled area.

Security tags may generally comprise one of two types. One type of security tag may be designed for reuse. For example, a security tag may be detached from the monitored item at the point of sale in a manner that does not substantially harm the integrity of the security tag, either externally or internally. Once detached, the reusable tag may be reattached to another item. Another type of security to may be designed for single use. For example, a security tag may be detached from the monitored item at the point of sale in a manner that typically harms the integrity of the security tag. Once detached, a single-use security tag cannot be reattached again to another item.

Both types of security tags may be unsatisfactory for a number of reasons. For example, conventional reusable security tags may be relatively expensive since they are made to be durable enough to withstand the rigors of continuous attaching and detaching from monitored items. Single-use security tags, however, may not be economical, or secure enough to meet the design constraints for a given security system. Consequently, there may be a need for an improved EAS system to solve these and other problems.

Another application for security tags is to be reusable with very small items, like and accessories. The tag should be small, light weight, not interfere with merchandise display, difficult to defeat and easy to attach and detach.

BRIEF DESCRIPTION OF THE INVENTION

In accordance with one embodiment, a security tag is provided that includes a housing, one or more electronic sensors held within the housing, an accessory pin provided with the housing and a lock assembly held within the housing. In an embodiment, the accessory pin may be moveable with respect to the housing. For example, the accessory pin may be moved between a locked and an unlocked position. The accessory pin may be configured to secure to an accessory. When the accessory pin is in the locked position, the tag housing is secured to the accessory. When the accessory pin is in the unlocked position the tag housing may be disengaged from the accessory. Hence, by moving the pin between the locked and unlocked positions, respectively, the tag housing may be engaged and disengaged with the accessory.

In one embodiment, the lock assembly is also held within the housing. The lock assembly may have a magnetically influenced (MI) member. The MI member may have a relaxed position and a biased position. The MI member may move from the relaxed position to the biased position when exposed to a select magnetic field. The MI member may move from the biased position to the relaxed position in the absence of the selected magnetic field. Optionally, the MI member may move from the biased position to the relaxed position when exposed to another magnetic field.

The MI member may be positioned to change the lock assembly between a locked position and an unlocked position. For example, the lock assembly may be in a locked position when the MI member is in a relaxed position. Alternatively, the lock assembly may be in a locked position when the MI member is in a pre-loaded d position. Alternatively, the lock assembly may be in an unlocked position when the MI member is in a biased position.

The security tag housing may have an exterior that includes a detacher reference surface. The detacher reference surface may be configured to be positioned adjacent to a detacher. The detacher may produce the select magnetic field. For example, the MI member may be oriented relative to the detacher reference surface such that when the detacher reference surface is located adjacent to the detacher, the MI member is exposed to the select magnetic field. The MI member may change from the relaxed position to the biased position which changes the lock assembly from the locked position to the unlocked position.

The security tag housing may have an interior that includes a pin retention track and a lock acceptance chamber. The accessory pin may be rigid, and have a base arm and a locking arm. In one embodiment, the base arm may be slidably maintained within the pin retention track. The locking arm may be used to place the accessory pin in the locked position. For example, the locking arm may be removed from the lock acceptance chamber when the accessory pin is moved between the locked and unlocked positions, respectively.

In one embodiment, the locking arm may be free to rotate about the base arm when removed from the lock acceptance chamber, to facilitate attachment or removal of an item.

In another embodiment, the base arm may be removable from the pin retention track, to facilitate attaching a different accessory pin.

In another embodiment, the accessory pin may be flexible, in whole or in part, which enables it to be wrapped around an item. In another embodiment, the accessory pin may have a flexible member and a rigid locking arm.

In one embodiment, the accessory may be made from a metal, for example steel, which would make it difficult to cut.

In one embodiment, the locking assembly includes a pin engaging member. The pin engaging member may move into and out of the lock acceptance chamber. The pin engaging member by moving into and out of lock acceptance chamber may engage and disengage the locking arm. For example, the locking arm may be in the locked position when engaged. Optionally, the locking arm may be in the unlocked position when disengaged. The MI member may move the pin engaging member when the MI member is exposed to the select magnetic field.

In one embodiment, the locking assembly may include a wedge base that is fixedly secured within the tag housing. The MI member may include a spring body. The spring body may have an MI arm at one end and a pin engaging member at an opposite end. For example, the MI arm may move from the relaxed position to the biased position when exposed to the select magnetic field.

In one embodiment, the locking assembly may include a spring body having an MI arm that extends along a longitudinal axis. Optionally, the MI arm may be oriented at a non-parallel angle to the select magnetic field when in the locked position. Alternatively, the MI arm may rotate to an angle more parallel to the select magnetic field when in the unlocked position.

In another embodiment, the accessory pin may include a locking arm with teeth thereon. Alternatively, the lock assembly may include a pin engaging member that engages the teeth when in the locked position.

In another embodiment, the tag may be substantially larger such that it could be attached to larger items.

BRIEF DESCRIPTION OF THE DRAWINGS

The drawings illustrate generally, by way of example, but not by way of limitation, various embodiments discussed in the present document.

FIG. 1(*b*) is a perspective view of the tag in an unlocked position in accordance with an embodiment.

FIG. 2(*b*) is a perspective view of a spring body as shown in FIG. 2(*a*).

FIG. 2(*c*) is a perspective view of an alternate embodiment of the spring body.

FIG. 2(*d*) is a perspective view of a wedge as shown in FIG. 2(*a*).

FIG. 4(*b*) is a sectional view of the detacher in accordance with an embodiment.

FIG. 4(*c*) illustrates a select magnetic field produced by a detacher magnet.

FIG. 4(*d*) illustrates movement of a lock assembly under the influence of the select magnetic field.

FIGS. 7(*b*) and 7(*c*) are perspective views of tag protrusions formed on a security tag in accordance with an embodiment.

DETAILED DESCRIPTION OF THE INVENTION

The foregoing summary, as well as the following detailed description of certain embodiments of the subject matter set forth herein, will be better understood when read in conjunction with the appended drawings. As used herein, an element or step recited in the singular and proceeded with the word "a" or "an" should be understood as not excluding plural of said elements or steps, unless such exclusion is explicitly positioned. Furthermore, references to "one embodiment" are not intended to be interpreted as excluding the existence of additional embodiments that also incorporate the recited features. Moreover, unless explicitly positioned to the contrary, embodiments "comprising" or "having" an element or a plurality of elements having a particular property may include additional such elements not having that property.

In the following detailed description, reference is made to the accompanying drawings which form a part hereof, and in which are shown by way of illustration specific embodiments in which the subject matter disclosed herein may be practiced. These embodiments, which are also referred to herein as "examples," are described in sufficient detail to enable those skilled in the art to practice the subject matter disclosed herein. It is to be understood that the embodiments may be combined or that other embodiments may be utilized, and that structural, logical, and electrical variations may be made without departing from the scope of the subject matter disclosed herein. The following detailed description is, therefore, not to be taken in a limiting sense, and the scope of the subject matter disclosed herein is defined by the appended claims and their equivalents. In the description that follows, like numerals or reference designators will be used to refer to like parts or elements throughout. In this document, the terms "a" or "an" are used, as is common in patent documents, to include one or more than one. In this document, the term "or" is used to refer to a nonexclusive or, unless otherwise indicated.

Figure 1A:
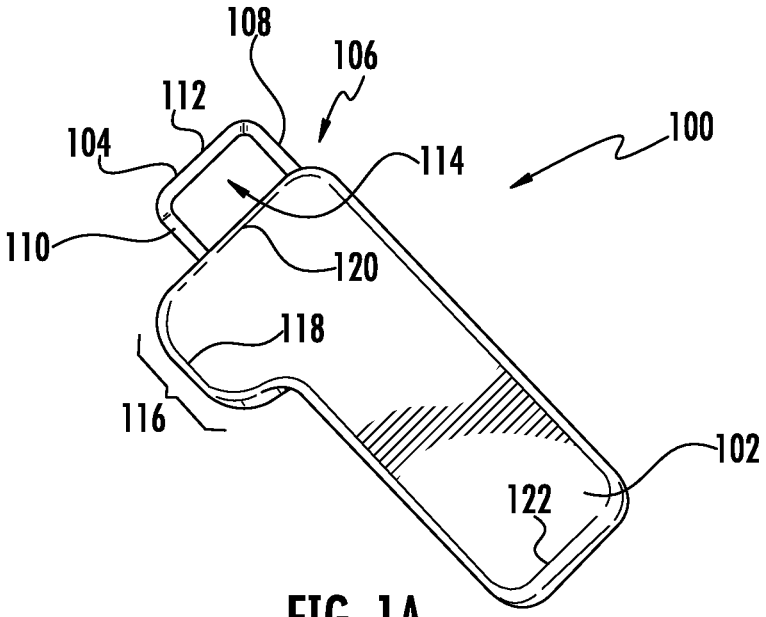
FIG. 1(*a*) is a perspective vie of a tag in a locked position in accordance with an embodiment.

FIG. 1(*a*) is a perspective view of a security tag 100 in a locked position in accordance with an embodiment. FIG. 1(*b*) is a perspective view of the security tag 100 in an unlocked open position 150 in accordance with an embodiment. The security tag 100 includes a housing 102 comprising a first end 120 and a second end 122. The security tag 100 also includes an accessory pin 104 provided with the housing 102 at the second end 122. The accessory pin 104 moves with respect to the housing 102 between locked and unlocked positions. The accessory pin 104 may be configured to couple the security tag 100 to an accessory when the accessory pin 104 is in the locked position. For example, the accessory may be any ornament including jewelry. The accessory pin 104 engaging and disengaging the housing 102 when the accessory pin 104 is moved between the locked and unlocked positions, respectively.

The pin 104 may have three parts, a first part forming a base arm 108, a second part forming a locking arm 110 and a third part forming a joining section 112 that joins the base arm 108 and the locking arm 110. Optionally, the accessory pin 104 may be formed using multiple parts having an opening between the base arm 108 and the locking arm 110. In one embodiment, the accessory pin 104 may be a U shaped that may couple the security tag 100 to the accessory. Optionally, the accessory pin 104 may be V-shaped, C-shaped, and the like. Alternatively, the accessory pin 104 may be any shape. Alternately, the base arm 108, joining section 112, locking arm 110 may be either rigid or flexible. The accessory pin may have the base arm 108 longer than the locking arm 110. The accessory pin 104 and the housing 102 may form a receiving area 114 for partially placing the accessory.

Figure 1B:
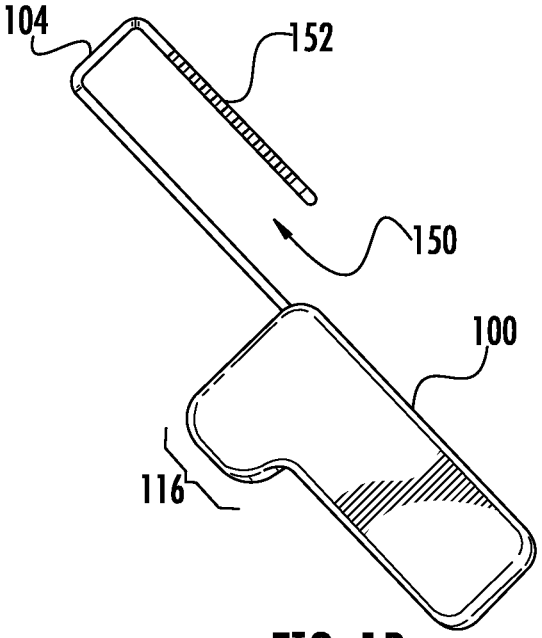
Figure 2A:
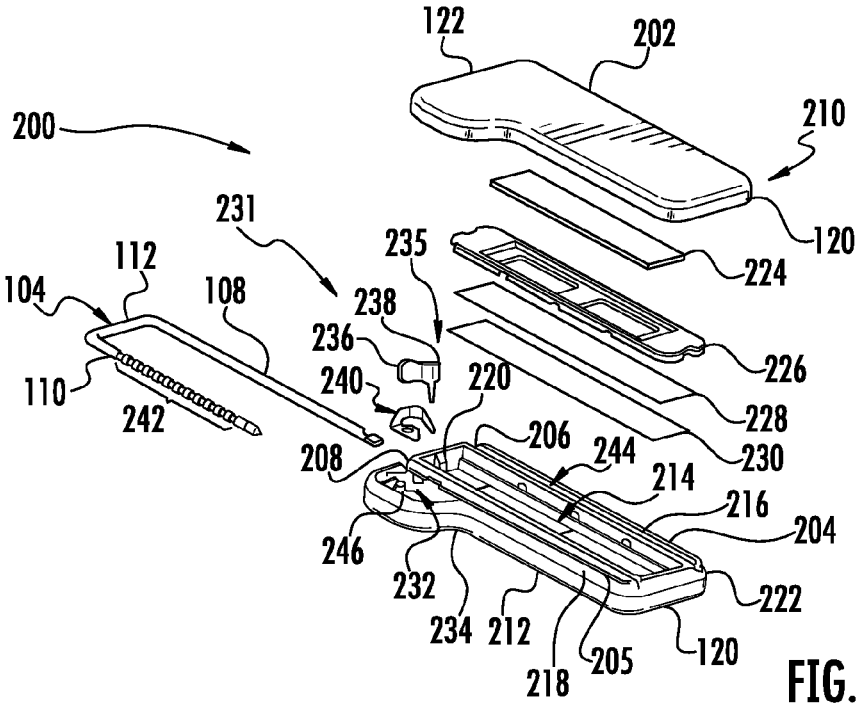
FIG. 2(*a*) is an exploded view of the tag ifs accordance with an embodiment.
Figure 2B:
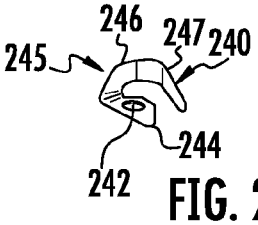
Figure 2C:
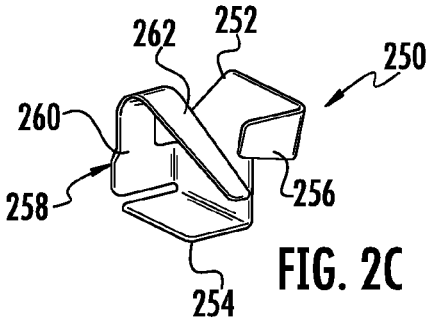
Figure 2D:
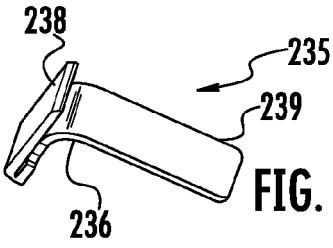

In one embodiment, when the accessory pin 104 is in the locked position, both the base arm 108 and the locking arm 110 are positioned within the housing 102. In one embodiment, when the accessory pin 104 is in the open position (FIG. 1*b*), the base arm 108 is placed within the housing 102 and the locking arm 110 is released from and moves outside of the housing 102, such that the accessory pin is connected only to the housing 102 via the base arm 108. Optionally, when the accessory pin 104 is in the unlocked/open position, both the base arm 108 and the locking arm 110 is released from the housing 102 such that the accessory pin 104 is completely separated from the housing 102. As shown in FIG. 1*b*, the locking arm 110 may have one or more grooves or teeth 152 thereon.

In one embodiment, when the accessory pin 104 is in an open position, the shorter locking arm 110 may form a conduit, providing access to the receiving area 114. For example, the conduit may allow access to the receiving area 114 to partially place the accessory in the receiving area 114. For example, the conduit may allow access to the receiving area 114 to remove the accessory from the receiving area 114.

Optionally, the base arm 108 and the locking arm 110 may both be removed from the housing 102, such that the accessory pin 104 is completely separated from the housing 102, a conduit to the receiving area 114 may be formed between the base arm 108 and the locking arm 110.

The security tag 100 may be implemented as a reusable security tag or a single-use security tag. The embodiments disclosed herein are not limited in this context. In one embodiment, for example, security tag 100 may be implemented using a reusable housing 102 and accessory pin 104. A reusable security tag 100 may be detached from the accessory in a manner that does not substantially harm the integrity of the security tag 100, either externally or internally. Once a reusable security tag 100 is detached, it may generally be reattached to another item. Detachment indicates the accessory pin 104 is the unlocked/open position.

In one embodiment, for example, security tag 100 may be implemented using a single-use housing 102 and accessory pin 104. A single-use security tag 100 may be detached from the monitored item in a manner that typically harms the integrity of the security tag. Once a single-use security tag 100 is detached, it generally cannot be reattached again to another item.

The security tag 100 may be implemented using various materials, to include various types of metals and plastics. For example, accessory pin 104 may be formed using plastic and/or steel. For example, different amount of magnetic material may be used within security tag 100. For example, the accessory pin 104 may be rigid or flexible. Optionally, the housing 102 may be implemented using a plastic material. Optionally, a non-magnetic metal, such as stainless steel or aluminum may be used to manufacture the housing 102. The embodiments, however, are not limited to a particular material for the tag 100.

In one embodiment, the housing 102 may be used to attach security tag 100 to an item. The item may comprise any commercial good, such as jewelry, a garment, article of clothing, zippers, shoes, glasses, packaging material, boxes, and so forth. In one embodiment, the housing 102 may also include additional features, such as a lanyard or security strap. The lanyard or security strap may allow security tag 100 to be used with items where the accessory may not be partially placed within the receiving area 114. For example, the accessory may be items such as sports equipment, hand tools, electronics and any other product may be secured with the lanyard through a stable portion of the packaging or product itself. The embodiments of the subject matter disclosed herein are not limited to the accessory that may be secured using the tag 100.

In one embodiment, the security tag 100 may be smaller in size than some conventional security tags. In one embodiment, for example, the security tag 100 may be approximately 2.6 inches long, 0.8 inches wide, and 0.25 inches thick. The total weight may be approximately 6 grams. The subject matter disclosed herein, however, is not limited to these particular metrics.

In another embodiment, the security tag 100 could be larger and stronger in size to make it suitable for attachment to larger items, such as sporting goods and hand tools.

In one embodiment, the exterior of the housing 102 may also comprise a detacher reference surface 116 for use with a detaching device or detacher. The detacher reference surface 116 to be positioned adjacent to a detacher, such as magnetic detaching device, that produces a select magnetic field. The tag 100 is configured such that when the detacher reference surface is located adjacent to the detacher, the tag 100 may be exposed to a select magnetic field and causes the accessory pin to switch between the locked position and the unlocked position.

For example, the detacher reference surface 116 may include a protrusion 118, wherein the protrusion 118 may comprise any shape, as long as the shape appropriately interfaces with the detacher. For example, the protrusion 118 may have a semicircular shape or a cylindrical shape.

In one embodiment, the tag 100 may have an electronic device to communicate with a sensor. For example, the tag 100 may have a radio frequency label or chip. The label and the sensor may be part of an Electronic Article Surveillance ("EAS") system. Alternatively, the tag 100 may have a tamper proofing mechanism to discourage tampering of the tag. For example, the tamper proofing mechanism may be part of the EAS system, where the EAS system raises alarm when the tag 100 stops responding. Optionally, the tag 100 may have an ink pocket inside the housing that may leak onto the protected item from the tag 100 to discourage tampering.

FIG. 2(*a*) is an exploded view 200 of the security tag 100 in accordance with an embodiment. The tag 100 comprises an upper housing cover 202, and a lower housing cover 204 joined together to form the housing 102. The upper housing cover 202 and the lower housing cover 204 may be joined at seam 205 to form the security tag 100. The upper housing cover 202 and the lower housing cover 204 may be made of a semi-hard or rigid material. A usable rigid or semi-hard material may include a hard plastic such as an injection molded Acrylonitrate-Butadiene-Styrene (ABS) plastic, or a plastic such as polycarbonate. When a plastic material is used, the mating of the upper housing cover 202 and the lower housing cover 204 may be accomplished using an ultrasonic weld, snap fitting, or any other suitable joining mechanism desired for a given implementation.

In one embodiment, first end 120 may further comprise a first aperture 206 and a second aperture 208. The first aperture 206 and the second aperture 208 extent between the upper housing cover 202 and the tower housing cover 204. Alternatively, the first aperture 206 and the second aperture 208 extent may be available in either the upper housing cover 202 or the lower housing cover 204. The first aperture 206 may be used to receive the base arm 108 of the accessory pin 104. The second aperture 208 may be used to receive the locking arm 110 of the accessory pin 104.

The upper housing cover 202 and the lower housing cover 204 may be partially hollow between an upper surface 210, a lower surface 212, the first end 120 and the second end 122. A first compartment 214 may be formed, within the hollow space, between a first wall 216, a second wall 218, a third wall 220 and a fourth wall 222. One or more electronic sensors may be held within the housing confined in the first compartment 214. The electronic sensor may comprise a bias magnet 224, a spacer 226, a first resonator 228 and a second resonator 230. Alternatively, the electronic sensor may be a radio frequency identification label, a tuned circuit or another EAS device.

The protrusion 118, that forms part of the detacher reference surface 116, may be integrally formed as part of the upper housing cover 202 and the lower housing cover 204. A second compartment (lock acceptance chamber 232) may be formed between the protrusion 118 and the first wall 216. The second compartment 232 may include a lock acceptance chamber 234. For example, the locking arm 110 may be slidably maintained within a lock acceptance chamber 234 within the lock acceptance chamber 232. For example, the locking arm 110 may be removed from the lock acceptance chamber 232 when the accessory pin 104 is moved between the locked and unlocked positions, respectively.

In one embodiment, a lock assembly 231 comprises of the accessory pin 104, a wedge 235 having a magnetically influenced (MI) member 236 and a pin engaging member 238, and a spring body 240 to support the wedge 235 (the MI member 236 and the pin engaging member 238) at the locking position. FIG. 2(*b*) is a perspective view of the spring body 240 as shown in FIG. 2(*a*). The spring body 240 is placed within the lock acceptance chamber 232 wherein the spring body may have an opening 242 in the spring base 245. The acceptance chamber 232 may have a pin 246 that may receive the opening 242. The pin 246 supports the spring body 240 and the spring body extends from the pin 246 such that the base 245 may be fixedly secured within the acceptance chamber 232. The pin 246 and the spring body 240 when assembled fit within the acceptance chamber 232. The spring body 240 may have a spring tab 245. The spring tab 245 may have a tab body 246 and a spring arm 247. The spring arm 247 may be deflectable and may distally extend from the tab body 246. The spring body 240 may be comprised of steel, or any other flexible material.

FIG. 2(*c*) is a perspective view of an alternate embodiment of the spring body 250. The spring body 250 may not have an opening like spring body 240; alternatively, the spring body 250 has a base 252 to fit within the lock acceptance chamber 232. Additionally, the spring body 250 may have a First support tab 254 and a second support tab 256 extending from the base and oriented to support the spring body 250 within the lock acceptance chamber 232. The spring body 250 may also include a spring tab 258. The spring tab 258 may have a tab body 260 and a spring arm 262. The spring arm 262 may be deflectable and may distally extend from the tab body 260.

FIG. 2(*d*) is an alternate perspective view of the wedge 235 as shown in FIG. 2(*a*). The wedge 235 comprises of the MI member 236 and the pin engaging member 238. The MI member 236 may have a relaxed position and a biased position. The MI member 236 moves from the relaxed position to the biased position when exposed to a select magnetic field. The MI member 236 may move from the biased position to the relaxed position in the absence of the selected magnetic field. Optionally, the MI member 236 may be configured to move from the biased position to the relaxed position when exposed to another magnetic field. The MI member 236 may be formed using a ferromagnetic material. For example, the MI member 236 is formed of an iron metal.

The MI member 236 is positioned to change the lock assembly 231 between a locked position and an unlocked position. For example, the lock assembly 231 may be in a locked position when the MI member 236 is relaxed position. Alternatively, the lock assembly 231 may be in a locked position when the MI member 236 is in a preloaded position. Alternatively, the lock assembly 231 may be in an unlocked position when the MI member 236 is in a biased position.

The pin engaging member 238 moves into and out of the lock acceptance chamber 234. The pin engaging member 238, by moving into and out of lock acceptance chamber 234, engages and disengages the locking arm 110. The locking arm 110 is in the locked position when engaged. Alternatively, the lock assembly 231 may include a pin engaging member 238 that engages the teeth 243 when the accessory pin 104 is in the locked position. When the MI member 236 is placed in the select magnetic field, produced by a magnetic detacher, the pin engaging member 238 will release the teeth 243, allowing the accessory pin 104 to extend outwards sufficiently to allow removal of an accessory being secured by the tag 100. The teeth 243 on the locking arm 110 of the accessory pin 104 have groves that provide multiple locking positions. The multiple locking positions allow adjustment of the length of the receiving area 114 to receive items of various sizes.

The locking arm 110 is in the unlocked position when disengaged. The MI member 236 is at a substantially non-parallel orientation to the pin engaging member 238. In one embodiment, the MI member 236 is approximately perpendicular to the pin engaging member 238. The relative orientation of the MI member 236 and pin engaging member 238 can be selected to optimize the magnetic coupling between the MI member 238 and the detacher magnetic field to create the desired opening rotational force. The MI member 236 moves the pin engaging member 238 when the MI member 236 is exposed to the select magnetic field. The MI member 236 has an MI arm 239 that extends longitudinally. The MI arm may move from the relaxed position to the biased position when exposed to the select magnetic field. When the security tag 100 is in a locked position, the MI arm 239 is oriented at a non-parallel angle to the select magnetic field. The MI arm 239 rotates under the influence of the magnetic field to a more parallel orientation relative to the select magnetic field when the security tag 100 is in the unlocked position.

A third compartment within the housing 102 may represent a pin retention track 244. The base arm 108, extending outward from the housing 102 via the aperture 206, may be partially placed within the pin retention track 244. The base arm 108 is slidably maintained within the pin retention track 244. When the accessory pin 104 is in a unlock, position, the base arm 108 is held within the pin retention track 244.

In another embodiment, the pin joining section 112 may be flexible, and the base arm 108 may be in a fixed position within the pin retention track 244.

Figure 3:
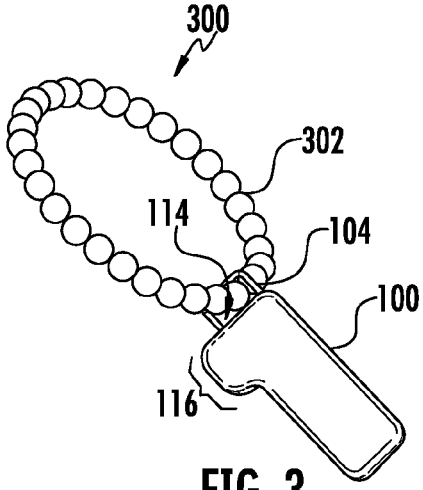
FIG. 3 is a perspective view of the tag coupled to an accessory in accordance with an embodiment.
Figure 4A:
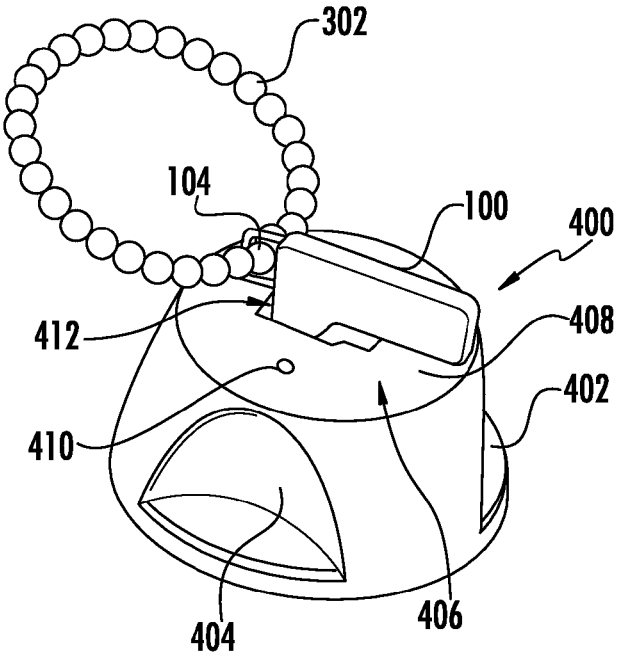
FIG. 4(*a*) is a perspective view of a detacher in accordance with an embodiment.
Figure 4B:
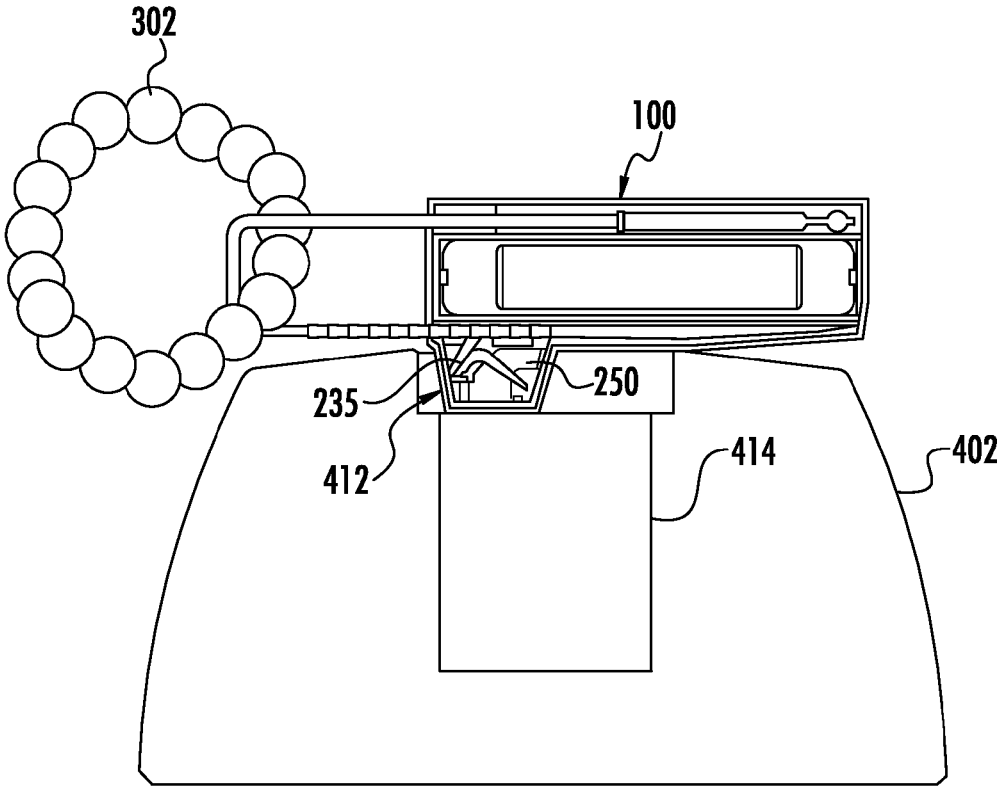
Figure 4C:
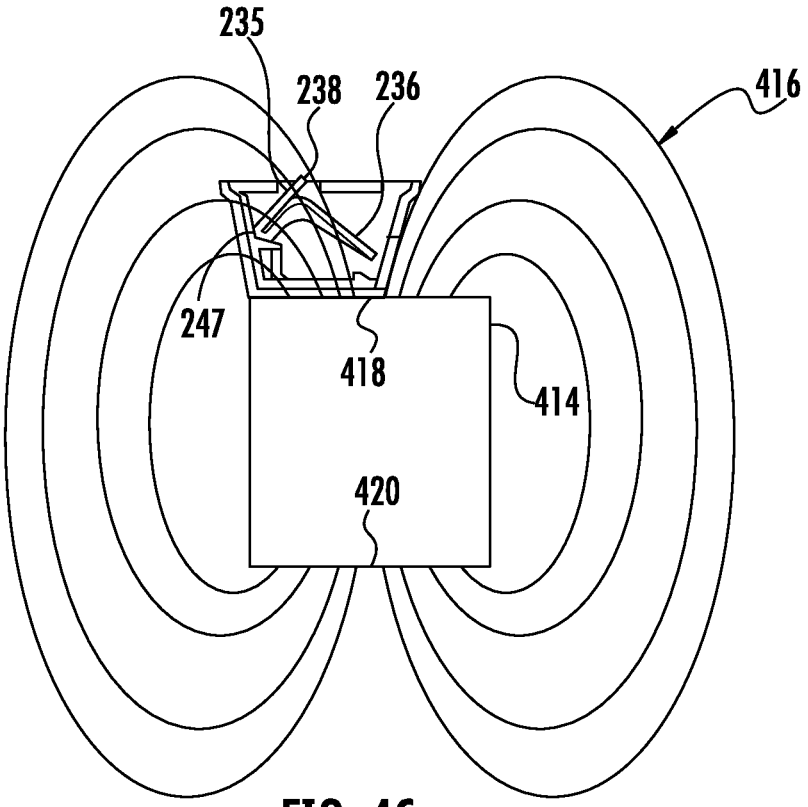
Figure 4D:
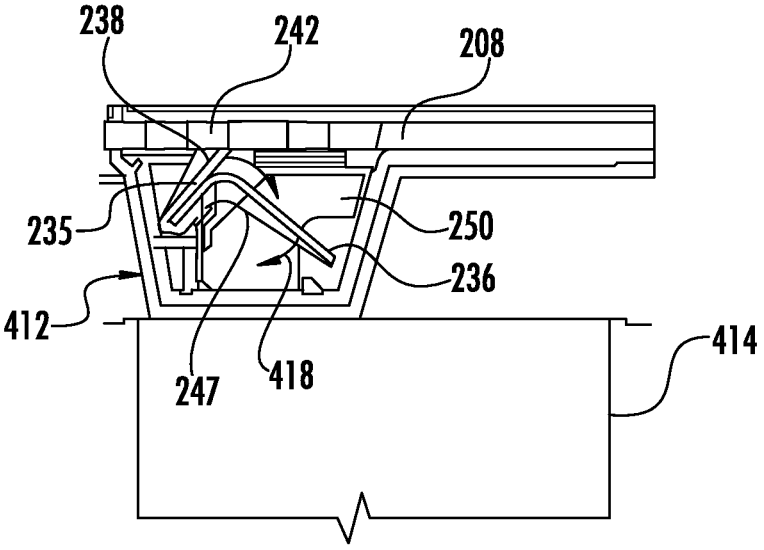

FIG. 3 is a perspective view 300 of the security tag 100 coupled to an accessory 302 in accordance with an embodiment. When the accessory pin 104 is in the locked position, both the base arm 108 and the locking arm 110 are positioned within the housing 102. Whereas, when the accessory pin 104 is in the open position, the base arm 108 is placed within the housing 102 and the locking arm 110 is released from and moves outside of the housing 102, such that the accessory pin is connected only to the housing 102 via the base arm 108. When the accessory pin 104 is in an open position, the shorter locking arm 110 may form a conduit, providing access to the receiving area 114. For example, the conduit may allow access to the receiving area 114 to partially place the accessory in the receiving area 114. For example, the conduit may allow access to the receiving area 114 to remove the accessory from the receiving area 114. As shown in FIG. 3, both the base arm 108 and the locking arm 110 are positioned within the housing 102, thereby securing the accessory 302 within the receiving area 114 of the security tag 100.

FIG. 4(*a*) is a perspective view a detacher 400 formed in accordance with an embodiment. FIG. 4(*a*) show view of the security tag 100, coupled to an accessory 302, aligned over a magnetic detacher 400. The detacher 400 has an outer housing 402 comprising a holding area 404, allowing user to hold the detacher 400 by hand, and a tag interface area 406, wherein the tag 100 may be placed to interact with the detacher 400.

The housing 406 may be, for example, suitable for countertop mounting where the tag receiving area 404 is above the surface of the countertop. A different housing with a bezel may be suitable for mounting in a hole in the countertop such that the opening for tag receiving cavity 404 is flush or nearly flush with the countertop surface.

The tag interface area 406 may include a surface area 408 for placing the tag 100 body on the detacher 400 and a status indicator light 410. The status indicator light 410 may be configured to communicate status of the detachment process. For example, when the tag 100 is successfully detached from the accessory 302, the status indicator light 410 may display green light. For example, when the detacher 400 is unsuccessful in detaching the tag 100 from the accessory 302, the status indicator light 410 may display red light.

The tag interface area 406 may also include a tag receiving cavity 412 configured to receive the detacher reference surface 116 therewithin. The width of the opening of the tag receiving cavity 412 may be broad so as to accept the detacher reference surface 116 loosely. Thus, the tag receiving cavity 412 may facilitate for easy insertion and removal of the detacher reference surface 116 by the user. The tag receiving cavity 412 also facilitates appropriate placement of the tag 100 within the selected magnetic field for detachment. The depth of the tag receiving cavity 412 may be configured to allow suitable detachment of the accessory pin 104 from the tag. For example, the width and depth of the tag receiving cavity 412 may be configured based on the width and depth of the detacher reference surface 116.

FIG. 4(*b*) is a sectional view of the detacher 400 in accordance with an embodiment. FIG. 4(*b*) also shows the sectional view of the tag 100 showing the detacher reference surface 116 placed within the tag receiving cavity 412. The detacher 400 may include a detacher magnet 414 to produce the select magnetic field. For example, the detacher magnet 414 may be a permanent magnet having a persistent magnetic field. Optionally, the detacher magnet 414 may be an electromagnet that may act as a magnet only when an electric current is passed through the electromagnet.

FIG. 4(*c*) illustrates a select magnetic field 416 produced by a detacher magnet 414. The detacher magnet 414 may produce the select magnetic field 416 causing the accessory pin 104 to switch between the locked position and the unlocked position. FIG. 4(*d*) illustrates movement of the locking assembly 231 under the influence of the select magnetic field 416. The MI member 236 may move from the relaxed position to the biased position when exposed to the select magnetic field. The space around the detacher magnet 414 contains a magnetic field, which is created by the movement of negatively, charged electrons. The magnetic field may be demonstrated, as shown in FIG. 4(*c*), by the magnetic field lines 416 (also called flux lines) that follow the longitudinal path between the first pole 418 and the second pole 420 of the detacher magnet 414. The first pole and the second pole is a north pole and a south pole or vice versa. However, the magnetic field lines always begin on the north pole of a magnet and end at the south pole of a magnet. When the MI member 236 is placed within the magnetic field lines, the MI member 236 magnetic poles align with the poles of the detacher magnet 414. The aligned magnetic poles of the MI member 236 are drawn toward the detacher magnet 414.

The MI member 236 moves downwards i.e. the biased position. As the MI member 236 moves down it pushes the spring arm 247 of the spring body 250 down. The downward motion of the wedge 235 moves the engaging member 238 will release the teeth 243, allowing the accessory pin 104 to extend outwards sufficiently to allow removal of the accessory 302 being secured by the tag 100.

The MI member 236 may move from the biased position to the relaxed position in the absence of the selected magnetic field 416. When the tag 100 is removed from the detacher 400, the select magnetic field 416 does not influence the MI member 236 and the spring arm 247 pushes the wedge 235 to the lock position. When in a lock position the engaging member 238 will hold the teeth 243, allowing the accessory pin 104 to be secured back into the second aperture 208.

Figure 5:
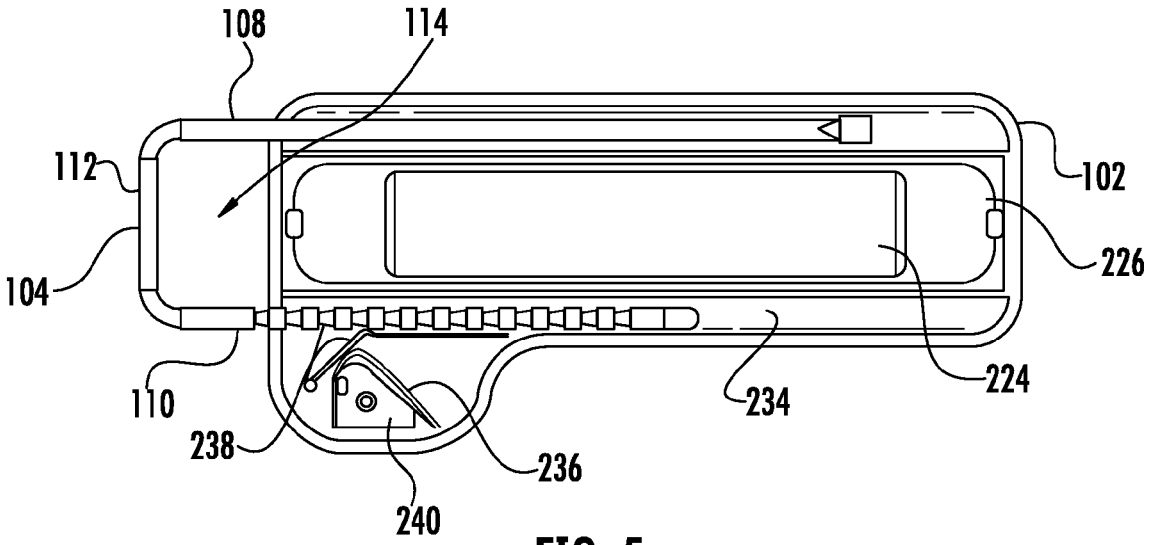
FIG. 5 is a sectional view of the security tag showing the pin engaging member in a locked status in accordance with an embodiment.
Figure 6:
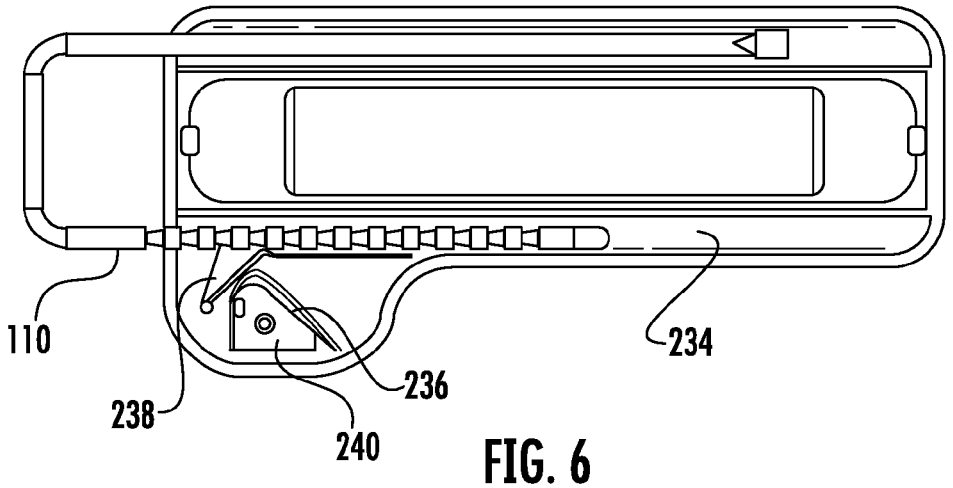
FIG. 6 is a sectional view of the security tag showing the pin engaging member in an unlocked status in accordance with an embodiment.

FIG. 5 is a sectional view of the security tag 100 showing the pin engaging member 238 in a locked status in accordance with an embodiment. FIG. 6 is a sectional view of the security tag 100 showing the pin engaging member 238 in an unlocked status in accordance with an embodiment. The pin engaging member 238 may move into and out of the lock acceptance chamber 234. The pin engaging member 238 by moving into and out of lock acceptance chamber 234 may engage and disengage the locking arm 110. The locking arm 110 is in the locked position when engaged by the pin engaging member 238 as shown in FIG. 5. When the MI member 236 is placed in the select magnetic filed, produced by a magnetic detacher 400 the pin engaging member 238 rotates downwards, as shown in FIG. 6. Thus, the rotation of the pin engaging member 238, releases the teeth 243 of the locking arm 110. The accessory pin 104 is in the open position thereby the accessory pin 104 may be extending outwards sufficiently to allow removal of an accessory being secured by the tag 100.

Figure 7A:
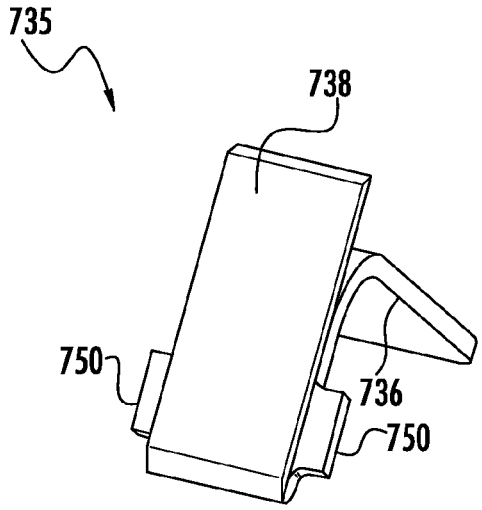
FIG. 7(*a*) is an alternate perspective view of the wedge.
Figure 7B:
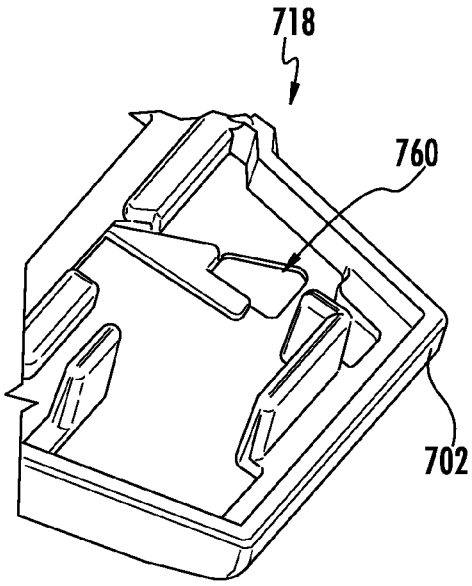
Figure 7C:
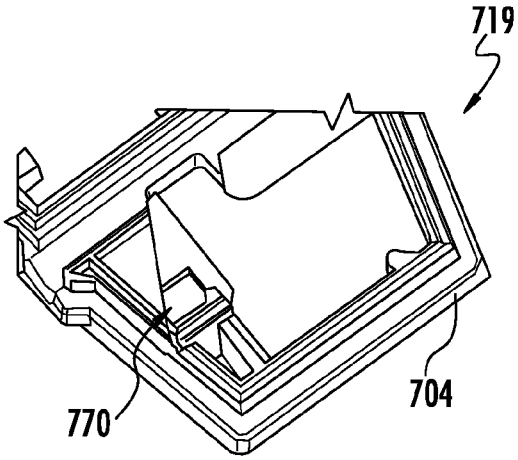

FIG. 7(*a*) is a perspective view of an alternative embodiment of a wedge 735. The wedge 735 comprises of an MI member 736 and a pin engaging member 738. The MI member 736 is positioned to change the lock assembly between a locked position and an unlocked position. For example, the lock assembly may be in a locked position when the MI member 736 is in a relaxed position. Alternatively, the lock assembly may be in a locked position when the MI member 736 is in a preloaded position. The wedge 735 includes a pair of wedge protrusions 750 extending outward from opposites side edges of the pin engagement member 738.

FIGS. 7(*b*) and 7(*c*) are perspective views of tag protrusions 718 and 719 formed on a security tag in accordance with an alternative embodiment. FIG. 7(*b*) illustrates the protrusion 718 in the upper housing cover 702, while FIG. 7(*c*) illustrates the protrusion 719 in the lower housing cover 704. Recesses 760 and 770 are provided in the upper and lower housing covers 702 and 704. The recesses 760 and 770 receive corresponding wedge protrusions 750 to assist retaining the wedge 735 in a desired position.

It is to be understood that the above description is intended to be illustrative, and not restrictive. For example, the above-described embodiments (and/or aspects thereof) may be used in combination with each other, in addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc, are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A security tag, comprising:

a housing;

at least one electronic sensor held within the housing;

an accessory pin provided with the housing, the accessory pin being formed of a rigid material and moveable with respect to the housing between locked and unlocked positions, where the accessory pin is configured to be secured to an accessory when in the locked position, the accessory pin engages and disengagees the housing when the accessory pin is moved between the locked and unlocked positions, respectively, and the accessory pin has a base arm and a locking arm maintained in a mutually parallel arrangement by a joining section therebetween; and a lock assembly held within the housing, the lock assembly having a resilient member and a magnetically influenced (MI) member disposed adjacent to the resilient member;

wherein the resilient member comprises a support portion and a tab portion rotatably coupled to the support portion;

wherein the MI member is configured to move from a relaxed position to a biased position when exposed to a select magnetic field, whereby a first pushing force is applied by the MI member to the tab portion so as to cause the tab portion to rotate relative to the support portion in a first direction, and return from the biased position to the relaxed position in an absence of the select magnetic field, whereby the tab portion rotates relative to the support portion in a second direction such that a second pushing force is applied by the tab portion to the MI member so as to cause the MI member's return to the relaxed position; and wherein the MI member changes the lock assembly between locked and unlocked positions when the MI member moves between the relaxed and biased positions, respectively, in response to the select magnetic field.

2. The security tag of claim 1, wherein the housing has an exterior that includes a detacher reference surface configured to be positioned adjacent to a detacher that produces the select magnetic field, the MI member being oriented relative to the detacher reference segment such that when the detacher reference surface is located adjacent to the detacher, the MI member is exposed to the select magnetic field and changes the lock assembly from the locked to the unlocked position.

3. The security tag of claim 1, wherein the housing has an interior that includes a pin retention track and a lock acceptance chamber, the base arm being slidably maintained within the pin retention track, the locking arm entering, and being removed from, the lock acceptance chamber when the accessory pin is moved between the locked and unlocked positions, respectively.

4. The security tag of claim 1, wherein the locking assembly includes a pin engaging member that moves into and out of the lock acceptance chamber to engage and disengage the locking arm when in the locked and unlocked positions, the MI member moving the pin engaging member when the MI member is exposed to the select magnetic field.

5. The security tag of claim 1, wherein the support portion of the resilient member is fixedly secured within the housing, the MI member include a wedge body having an MI arm at one end and a pin engaging member at an opposite end, and the MI arm moves from the relaxed position to the biased position when exposed to the select magnetic field.

6. The security tag of claim 1, wherein the MI member includes an MI arm that extends along a longitudinal axis, the MI arm is oriented at a non-parallel angle to the select magnetic field when in the locked position, and the MI arm is rotated towards a parallel angle to the select magnetic field when in the unlocked position.

7. The security tag of claim 6, wherein the MI member is at a non-parallel orientation to the pin engaging member.

8. The security tag of claim 1, wherein the locking arm has a plurality of teeth thereon corresponding to a plurality of locking positions, and includes a pin engaging member that engages with at least one of the plurality of teeth when in one of the plurality of locking positions.

9. The security tag of claim 1, wherein the select magnetic field is produced by a detacher magnet.

10. The security tag of claim 9, wherein the detacher magnet is a permanent magnet.

11. The security tag of claim 9, wherein the detacher magnet is an electromagnet.

12. The security tag of claim 5, wherein the MI member is formed from a ferromagnetic material, and the pin engaging member is formed from a non-magnetic material.

13. The security tag of claim 1, wherein the accessory pin is selectively positionable in a plurality of locking positions within the lock acceptance chamber.

14. The security tag of claim 13, wherein the locking arm includes a plurality of teeth corresponding to the plurality of locking positions, and a pin engaging member that engages with at least one of the plurality of teeth.

15. A method of manufacturing a security tag, the method comprising:

providing a housing;

positioning at least one electronic sensor within the housing; and positioning a lock assembly within the housing, the lock assembly having a resilient member and a magnetically influenced (MI) member disposed adjacent to the resilient member, where the resilient member comprises a support portion and a tab portion rotatably coupled to the support portion;

moveably placing an accessory pin within the housing adjacent to the lock assembly, the accessory pin formed from a rigid material and having a base arm and a locking arm maintained in a mutually parallel arrangement by a joining section therebetween;

moving the MI member from a relaxed position to a biased position when exposed to a select magnetic field, whereby a first pushing force is applied by the MI member to the tab portion so as to cause the tab portion to rotate relative to the support portion in a first direction; and returning the MI member from the biased position to the relaxed position in an absence of the select magnetic field, whereby the tab portion rotates relative to the support portion in a second direction such that a second pushing force is applied by the tab portion to the MI member so as to cause the MI member's return to the relaxed position;

wherein the accessory pin engages an accessory when in a locked position, the MI member engages the accessory pin in the relaxed position to hold the accessory pin in the locked position, the MI member disengages the accessory pin in the biased position allowing the accessory pin to be moved to the unlocked position, and the MI member changes the lock assembly between locked and unlocked positions when the MI member moves between the relaxed and biased positions, respectively, in response to the select magnetic field.

16. The method of claim 15, wherein providing the housing further comprises providing a detacher reference surface, and positioning the detacher reference surface adjacent to a detacher, the detacher producing the select magnetic field, such that the select magnetic field changing the lock assembly from the locked to the unlocked position.

17. The method of claim 15, wherein providing the housing further comprises providing a pin retention track and a lock acceptance chamber, providing the accessory pin with a base arm and a locking arm to slidably maintain the base arm within the pin retention track, and slidably maintain the locking arm, wherein the locking arm enters and exits from the lock acceptance chamber when moving the accessory pin between the locked and unlocked positions, respectively.

18. The method of claim 15, wherein positioning the lock assembly further includes moving a pin engaging member in and out of the lock acceptance chamber, the pin engaging member engaging and disengaging the locking arm in the locked and unlocked positions, and configuring the MI member to move the pin engaging member when the MI member is exposed to the select magnetic field.

19. The method of claim 15, further comprising configuring a wedge body having an MI arm at one end and a pin engaging member at an opposite end, and moving the MI arm from the relaxed position to the biased position when exposed to the select magnetic field.

20. The method of claim 15, further comprising positioning the MI member such that an MI arm extends along a longitudinal axis, orienting the MI arm at a non-parallel angle to the select magnetic field when in the locked position, and rotating the MI arm towards a parallel angle to the select magnetic field when in the unlocked position.

21. The method of claim 15, wherein moveably placing the accessory pin includes configuring a locking arm with a plurality of teeth thereon, and causing a pin engaging member of the lock assembly to engage at least one of the plurality of teeth when in the locked position.

22. The method of claim 21, wherein the plurality of teeth provides multiple locking positions, and moveably placing the accessory pin further includes selectively positioning the locking arm within the lock acceptance chamber.

* * * * *